United States Patent [19]

Manfredi

[11] 4,111,745

[45] Sep. 5, 1978

[54] ADJUSTABLE BEARING ASSEMBLY FOR WEB DECURLING APPARATUS

[75] Inventor: John L. Manfredi, West Chester, Pa.

[73] Assignee: The Moore & White Company, Philadelphia, Pa.

[21] Appl. No.: 822,531

[22] Filed: Aug. 8, 1977

[51] Int. Cl.[2] ..... D21F 7/00

[52] U.S. Cl. ..... 162/271; 100/160; 162/197

[58] Field of Search ..... 162/271, 197; 226/199; 100/156, 160

[56] References Cited

U.S. PATENT DOCUMENTS

| | | | |
|---|---|---|---|
| 864,660 | 8/1907 | Love | 100/160 |
| 2,918,897 | 12/1959 | Zernov | 162/271 X |
| 3,546,067 | 12/1970 | Heidepriem | 162/271 |
| 3,971,696 | 7/1976 | Manfredi | 162/271 |

*Primary Examiner*—Richard V. Fisher

*Attorney, Agent, or Firm*—Stanley B. Kita

[57] ABSTRACT

Web decurling apparatus wherein a paper web is urged against a deformable roller by a decurling rod which extends parallel to the roller is provided with a series of improved bearing assemblies carried in spaced relation by a back-up beam which overlies the decurling rod to limit deflection thereof as decurling pressure is applied. Each bearing assembly is adjustable relative to the decurling rod and includes a mounting block fastened to the back-up beam, a pair of spindles each having an eccentric on one end journalled in the mounting block, and a roller bearing mounted on the eccentric end of each spindle. The other end of the spindle protrudes from the bearing block and is engageable by a tool to enable a technician to rotate the spindle about its axis and hence to rotate the bearing into proper engagement with the decurling rod. A set screw carried by the bearing block releasably engages the spindle for locking the bearing in a selected adjusted position.

9 Claims, 7 Drawing Figures

ADJUSTABLE BEARING ASSEMBLY FOR WEB DECURLING APPARATUS

FIELD OF THE INVENTION

The present invention relates to web decurling apparatus of the type having a decurling rod urged into pressure engagement with a deformable decurling roller, and more particularly, the present invention relates to back-up bearing assemblies for applying pressure to such decurling rods.

BACKGROUND OF THE INVENTION

Various types of web decurling machines are known. An example of a machine which functions satisfactorily to decurl paper webs is disclosed in U.S. Pat. No. 3,971,696 issued to the assignee of the present application. In brief, the machine disclosed in the patent decurls a paper web by causing an elongated rod to be urged into pressure engagement with a rubber covered roller as the paper web advances therebetween. The machine has means for varying the pressure applied to the decurling rod and means for pivoting the decurling rod about the rotational axis of the roller. An elongated beam overlies the decurling rod, and a series of bearing assemblies are interposed between the beam and the decurling rod to rotatably cradle the rod and to prevent it from deflecting excessively as pressure is applied to the web during the decurling process. Each bearing assembly includes a pair of anti-friction roller bearings mounted in tandem in a yoke which is fastened to the back-up beam. Although the patented machine functions satisfactorily for its intended purpose, there is a need for an improved bearing mounting arrangement.

For example, it is important for each of the bearing assemblies to accept its proportionate share of the load. Excessive bearing loads can cause the excessively loaded bearing to fail prematurely, resulting in costly maintenance on the machine and loss in production. Previous attempts to provide shims or wedges to adjust back-up bearing assemblies, such as disclosed in U.S. Pat. Nos. 2,918,897 and 864,660, have not been entirely satisfactory because of the amount of labor required for a technician to effect proper bearing adjustment.

OBJECTS OF THE INVENTION

With the foregoing in mind, a primary object of the present invention is to provide a novel assembly for mounting back-up bearings in web decurling apparatus.

It is another object of the present invention to provide an improved back-up bearing assembly which affords accurate adjustment of the bearings so that excessive bearing loads, and hence premature bearing failure, can be avoided.

Another object of the present invention is to provide for a web decurler a simple back-up bearing assembly which enables the bearings therein to be adjusted with a minimum of labor.

A further object of the present invention is to provide a relatively simple mechanism for enabling decurling rod back-up bearings to be adjusted so that the loads on the bearings can be substantially uniformly distributed.

A still further object of the present invention is to provide a unique decurling-rod bearing-mount which enables the bearings to be replaced readily should replacement become necessary.

Another object of the present invention is to provide a decurling rod back-up bearing assembly which is relatively inexpensive to manufacture yet which affords accurate bearing adjustment without any special tools.

SUMMARY OF THE INVENTION

A more specific object of the present invention is to provide certain improvements in web decurling apparatus of the type wherein a moving web is pressed between a roller having a resilient peripheral surface and a decurling rod rotatably cradled in a series of back-up bearing assemblies carried on the underside of a back-up beam. The improvements reside in the provision of means for enabling the back-up bearings to be adjusted accurately and readily relative to the decurling rod. Specifically, the improvements include a mounting block fastened to the back-up beam, a pair of spindles journalled in the block to rotate about axes parallel to one another and parallel to the decurling rod, and an anti-friction bearing mounted on one end of each spindle. The spindles are disposed so that the bearings are located on opposite sides of the mounting block to form a cradle for the decurling rod. The end of the spindle mounting the bearing is provided with an eccentric so that the rotational axis of the bearing is offset from the rotational axis of the spindle in the mounting block. The mounting block carries means for releasably engaging the spindle to lock the bearing in selected adjusted positions relative to the decurling rod. Preferably, the other end of each spindle protrudes from the block and has a series of diametrically-extending holes adapted to receive a tool to enable the spindle to be rotated during adjustment of the bearings.

These and other objects, features and advantages of the present invention should become apparent from the following description when taken in conjunction with the accompanying drawing.

DESCRIPTION OF THE PREFERRED EMBODIMENT

In U.S. Pat. No. 3,971,696 issued on July 27, 1976 to the assignee of the present application, there is disclosed a web decurling machine which is particularly suited for using the improved apparatus of the present invention. The web decurling machine disclosed in the patent comprises a roller having a resilient peripheral surface which engages the underside of a web and a small diameter decurling rod which engages the topside of the web. The decurling rod extends along the length of the roller and has opposite ends mounted in bearings in yokes which are capable of being pivoted about the axis of the roller to vary the point of engagement of the decurling rod with respect to the moving web. The yokes mount a back-up beam which overlies the decurling rod, and a series of bearing assemblies are interposed between the back-up beam and the decurling rod. The back-up bearing assemblies prevent the decurling rod from deflecting excessively when pressure is applied to the decurling rod by fluid actuators connected to the backup beam. Each bearing assembly includes a pair of bearings mounted in tandem between a like pair of yokes depending in spaced relation from the back-up beam. The bearings engage the decurling rod at spaced peripheral locations to keep it from deflecting as it rotates at high speeds while decurling the advancing web.

Although the web decurling apparatus disclosed in the aforementioned patent functions satisfactorily for its intended purpose, it has not been easy for a technician to set up the machine so that the back-up bearing assemblies accept evenly the load on the decurling rod. For instance, variations in the deflection of the decurling rod by as little as a few thousandths of an inch can cause uneven bearing loads. Uneven loads can result in premature bearing failure which is undesirable not only because of the cost of replace the worn bearings, but also because of the machine downtime which bearing replacement necessitates.

According to the present invention, the aforementioned problems associated with prior art back-up bearing assemblies are alleviated by the novel bearing assembly of the present invention. To this end, each bearing assembly is designed so that minute adjustments in the location of each bearing relative to the decurling rod can be effected. Moreover, each adjustment can be effected readily without any special tools.

Figure 1:
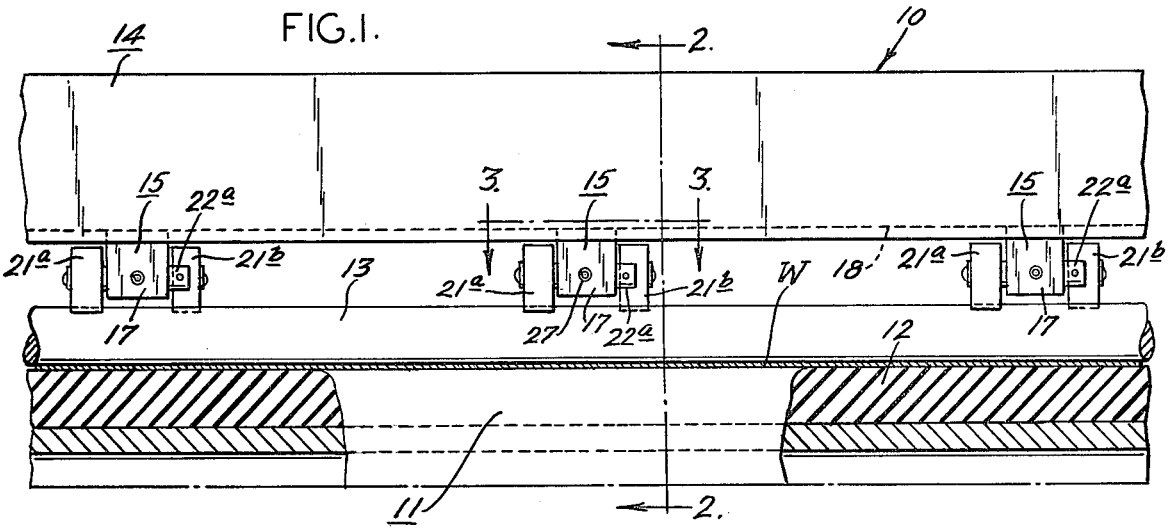
FIG. 1 is a partially-sectioned, front elevational view of a portion of a web decurling machine having decurling rod back-up bearing assemblies embodying the present invention.
Figure 2:
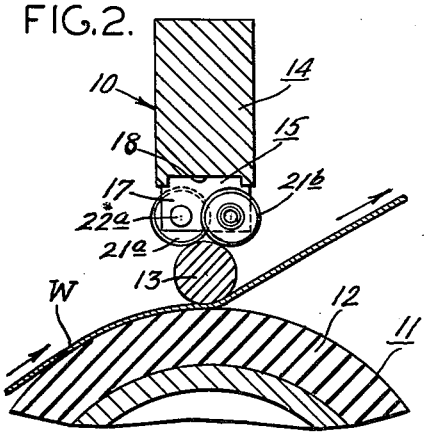
FIG. 2 is a sectional view taken on line 2—2 of FIG. 1.

As best seen in FIG. 1, the decurling machine 10 comprises a web decurling roller 11 mounted for rotation about a horizontal axis and having on its peripheral surface a layer 12 of rubber or other resilient material. A decurling rod 13 overlies the roller 11 and extends parallel thereto and is urged into pressure engagement with the topside of the advancing web W by means of a back-up beam 14 which extends in spaced parallel overlying relation with the decurling rod 13. To afford rotation of the decurling rod 13 upon rotation of the roller 11 and to prevent excessive deflection of the decurling rod 13 as pressure is applied radially inward against the web W, a series of bearing assemblies 15,15 are interposed between the back-up beam 14 and the decurling rod 13.

With this structure, curl in a moving web W is removed as the web W advances between the decurling rod 13 and the roller 11. For a more detailed description of the manner in which the aforedescribed structure functions to decurl the moving web W, reference is made to U.S. Pat. No 3,971,696 the disclosure of which is incorporated by reference herein.

Figure 4:
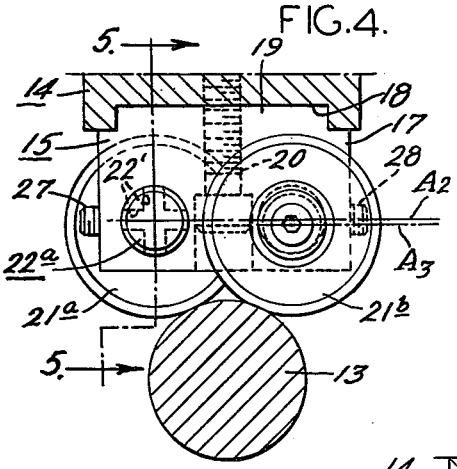
FIG. 4 is a sectional view taken on line 4—4 of FIG. 3.

In the illustrated embodiment of the present invention, each bearing assembly 15 comprises a mounting block 17 secured to the underside of the back-up beam 14. As best seen in FIG. 4, the back-up beam 14 is preferably provided with a longitudinally extending groove 18 which receives a tongue or shouldered upper portion 19 of the mounting block 17. The mounting block 17 is fastened to the back-up beam 14 by a cap screw 20 which projects upwardly and centrally through the mounting block 17. Preferably, the groove 18 in the back-up beam 14 and the tongue 19 of the bearing block 17 are accurately machined to snugly engage one another so as to prevent the mounting block 17 from cocking about a vertical axis through the cap screw 20.

Figure 3:
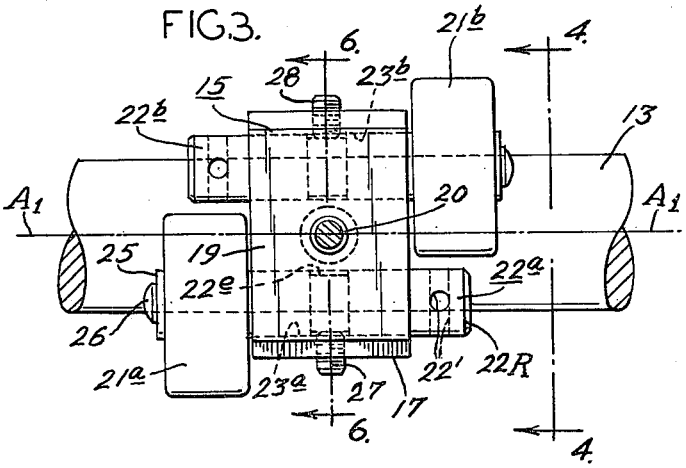
FIG. 3 is an enlarged plan view of the bearing assembly taken on line 3—3 of FIG. 1.

As best seen in FIG. 3, each bearing assembly 15 mounts a pair of anti-friction roller bearings **21*a* and 21*b* on opposite sides thereof. The rotational axes $A_3$ of the bearings 21*a* and 21*b* are disposed on opposite sides of the rotational axis $A_1$ of the decurling rod 13 so that the peripheral surfaces of the bearings 21*a* and 21*b* engage the surface of the decurling rod 13 at axially-spaced and peripherally-spaced locations. In other words, with respect to the path of movement of the web W, the bearings 21*a* and 21*b* are staggered and offset to form a cradle for the decurling rod 13**.

Figure 5:
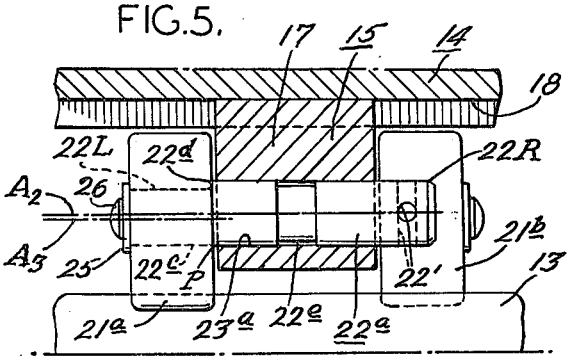
FIG. 5 is a sectional view taken on line 5—5 of FIG. 4.
Figure 6:
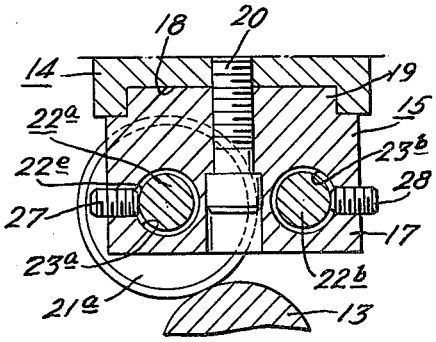
FIG. 6 is a sectional view taken on line 6—6 of FIG. 3.

In order to mount the bearings **21*a* and 21*b* to rotate about their axes, a pair of spindles 22*a* and 22*b* are mounted in bores 23*a* and 23*b*, respectively, in the bearing block 17. One end of each spindle mounts a bearing, and the other end of each spindle extends for a short distance beyond the opposite side of the mounting block 17. For instance, as best seen in FIG. 5, the lefthand end 22L of the spindle 22*a* mounts the front bearing 21*a*, and the righthand end 22R protrudes out of the mounting block 17. The spindle 22*b* is like the spindle 22*a*, except that the spindle 22*b* is reversed in the mounting block 17 so that the rear bearing 21*b* is located on the righthand side of the mounting block 17 (See FIG. 3**).

Figure 7:
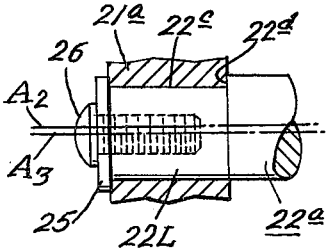
FIG. 7 is an enlarged, fragmentary sectional view of a portion of the bearing assembly.

For the purpose of disposing the periphery of each bearing in engagement with the peripheral surface of the decurling rod 13, the ends of the spindles mounting the bearings are provided with eccentric means for causing the rotational axis $A_3$ of the bearing to be offset from the rotational axis $A_2$ of the spindle. As best seen in FIG. 7, the left end 22L of the spindle **22*a* has a cylindrical surface 22*c* which is offset from the cylindrical surface of the spindle 22*a* and tangent thereto at one point P. See FIG. 5. The eccentric cylindrical surface 22*c* slidably receives the inner race of the roller bearing 21*a*, the inside edge of which engages an arcuate shoulder 22*d* extending radially outward at the juncture of the eccentric surface 22*c* and cylindrical surface of the spindle 22*a*. The other end of the bearing race is engaged by a washer 25, and a machine screw 26 is threadably engaged in a threaded bore extending axially inward in the eccentric end 22L of the spindle 22*a*. Thus, the bearing 21*a* is mounted securely but removably to the spindel 22*a***.

Preferably, the center of the eccentric cylindrical surface **22*c* (the rotational axis $A_3$ of the bearing 21*a*) is offset about 0.010 inches from the center or rotational axis $A_2$ of the spindle 22*a*. As a result, rotation of the spindle 22*a* about its axis $A_2$ (clockwise in FIG. 4) causes the rotational axis $A_3$ of the bearing 21*a* to move toward the peripheral surface of the decurling rod 13 and hence causes the periphery of the bearing 21*a* to move closer to the periphery of the decurling rod 13**.

To facilitate rotation of the spindle **22*a* about its axis $A_2$, the righthand terminal end 22R of the spindle 22*a* is provided with socket means, which, in the illustrated embodiment, includes a pair of diametrically-extending intersecting bores 22'. The bores are offset 90° with respect to one another, and each bore is dimensioned to receive the handle end of an Allen wrench or like tool. When inserted in one of the bores, the wrench can then be used to turn the spindle 22*a* about its axis $A_2$ for engaging the peripheral surface of the bearing 21*a* with the decurling rod 13. Of course, the spindle 22*b*** has a similar structure.

The spindles 22a and 22b are releasably secured in selected adjusted positions. To this end, a set screw or dog 27 is threadably received in the mounting block 13 and engages a peripheral groove 22e in the spindle 22a. A set screw 28 is similarly provided for the other spindle 22b. Preferably, the spindle bores are dimensioned so as to receive the handle of the set screw Allen wrench. Thus, the same Allen wrench can be used to loosen and tighten the set screws 27 and 28 and to rotate the spindles 22a and 22b to adjust the position of the bearings 21a and 21b relative to the decurling rod 13.

It is noted that the frictional force between the set screws 27 and 28 and the spindles 22a and 22b is sufficient to maintain the bearings 21a and 21b in adjusted positions even against substantial decurling rod pressures. This is achieved by virtue of the relatively small offset in the axes $A_2$–$A_3$ which, when coupled with the angular disposition of the spindle in the block, does not result in a moment arm of sufficient magnitude as to create any considerably turning force tending to cause the spindle to rotate about its axis $A_2$.

To set up the decurling rod 13 with respect to the decurling roller 11, the decurling rod 13 is placed on the peripheral surface of the roller 11. The set screws 27 and 28 in each bearing assembly are loosened by an Allen wrench, after which the handle of the wrench is inserted in a conveniently located spindle bore. The wrench handle is then used to turn the spindle relative to the mounting block until the surface of the bearing engages the surface of the decurling rod. Thereafter, the wrench is removed, and the set screw is tightened to lock the bearing in its adjusted position. This process is repeated for each bearing in each bearing assembly, preferably starting at one end of the decurling rod and working across. Thus, it may be seen that the adjustment is relatively simple and can be effected rapidly without any special tools. In the event that any bearing requires replacement, the spindle can be removed simply by loosening the set screw and pulling axially outward on the bearing. The bearing may be removed from the spindle upon removal of the machine screw 26.

In view of the foregoing, it should be apparent that the present invention provides improved means for enabling the bearings in bearing assemblies used in conjunction with decurling rods in a web decurling machine to be adjusted readily.

While a preferred embodiment has been described in detail, various modifications, alterations and changes may be made without departing from the spirit and scope of the present invention as defined in the appended claims.

I claim:

1. In web decurling apparatus including a roller having a resilient peripheral surface, a decurling rod extending parallel to the roller, and means for urging the decurling rod into pressure engagement with the roller for decurling a web advancing therebetween, incluing a back-up beam extending along the roller in spaced relation therewith and a series of bearing assemblies mounted to said back-up beam and engaging the decurling rod at spaced axial locations, the improvement wherein each bearing assembly comprises:

a mounting block fastened to said back-up beam, a spindle journalled in said block to rotate about an axis parallel to said decurling rod, an anti-friction bearing mounted on one end of said spindle, eccentric means on said one end of said spindle mounting the bearing for rotation about an axis offset from the rotational axis of the spindle in the mountng block, means to afford turning said spindle on its axis, and means carried by said mounting block for releasably engaging said spindle to lock the spindle in selected adjusted position, whereby the bearing may be accurately positioned so that its surface engages the surface of the decurling rod to provide back-up support at spaced axial locations.

2. Apparatus according to claim 1 wherein each bearing assembly includes a pair of spindles each mounting a bearing on one end and disposed in said block with said bearings on opposite sides of said block.

3. Apparatus according to claim 1 wherein each spindle has a cylindrical portion rotatably and axially slidably received in said mounting block and a terminal portion protruding from the side of the mounting block opposite the bearing, and said spindle turning means is provided on said terminal portion.

4. Apparatus according to claim 3 wherein said spindle turning means includes socket means in said terminal portion of said spindle for receiving a tool to turn said spindle.

5. Apparatus according to claim 1 wherein said spindle locking means includes a set screw threaded into said mounting block for engaging the spindle.

6. Apparatus according to claim 1 including means providing a groove in said back-up beam and means providing a tongue on said mounting block engaging in said groove to prevent the mounting block from pivoting about a vertical axis.

7. Apparatus according to claim 6 wherein said mounting block fastening means includes a threaded fastener projecting upwardly through said mounting block between said spindles and threadably received in said back-up beam.

8. Apparatus according to claim 1 including means releasably fastening said bearing to said one end of each spindle.

9. Apparatus according to claim 1 wherein the rotational axis of the bearing is offset from the rotational axis of the spindle about 0.010 inches.

* * * * *